US008912135B2

(12) United States Patent
Noce et al.

(10) Patent No.: US 8,912,135 B2
(45) Date of Patent: Dec. 16, 2014

(54) METHOD OF PROMOTING SOIL RELEASE FROM FABRICS

(75) Inventors: Gaelle Della Noce, Tourrettes sur Loup (FR); Teodora Doneva, Horgen (CH); Anne Oberlin, Anais (FR)

(73) Assignees: Rohm and Haas Company; Dow Global Technologies LLC

( * ) Notice: Subject to any disclaimer, the term of this patent is extended or adjusted under 35 U.S.C. 154(b) by 0 days.

(21) Appl. No.: 14/111,838

(22) PCT Filed: May 10, 2012

(86) PCT No.: PCT/US2012/037298

§ 371 (c)(1), (2), (4) Date: Oct. 15, 2013

(87) PCT Pub. No.: WO2012/161979

PCT Pub. Date: Nov. 29, 2012

(65) Prior Publication Data

US 2014/0066354 A1 Mar. 6, 2014

(30) Foreign Application Priority Data

May 20, 2011 (EP) ..... 11290236

(51) Int. Cl.

| | |
|---|---|
| ***B08B 3/04*** | (2006.01) |
| ***C11D 3/00*** | (2006.01) |
| ***C11D 3/22*** | (2006.01) |
| ***C11D 3/37*** | (2006.01) |

(52) U.S. Cl.

CPC ..... *C11D 3/0036* (2013.01); *C11D 3/225* (2013.01); *C11D 3/3757* (2013.01); *C11D 3/3765* (2013.01)

USPC ..... 510/361; 510/276; 510/434; 510/471; 510/473; 510/477

(58) Field of Classification Search

CPC ..... C11D 3/225; C11D 3/3757; B08B 3/04

USPC ..... 510/276, 361, 434, 471, 473, 477; 8/137

See application file for complete search history.

(56) References Cited

U.S. PATENT DOCUMENTS

| | | | | |
|---|---|---|---|---|
| 3,912,681 | A | 10/1975 | Dickson | |
| 4,000,093 | A | 12/1976 | Nicol et al. | |
| 4,136,038 | A | 1/1979 | Pracht et al. | |
| 4,170,557 | A | 10/1979 | Marco | |
| 5,900,396 | A | 5/1999 | Cala et al. | |
| 6,451,756 | B2 | 9/2002 | Shulman et al. | |
| 7,316,995 | B2 | 1/2008 | Penninger | |
| 2006/0046950 | A1 | 3/2006 | Penninger et al. | |
| 2009/0110870 | A1 | 4/2009 | Materniak et al. | |
| 2009/0239781 | A1 * | 9/2009 | Smalley et al. | 510/357 |
| 2012/0122753 | A1 * | 5/2012 | Schmiedel et al. | 510/325 |

FOREIGN PATENT DOCUMENTS

| | | | | |
|---|---|---|---|---|
| EP | 025551 | A1 | 3/1981 | |
| EP | 054325 | A1 | 6/1982 | |
| EP | 133566 | A2 | 2/1985 | |
| EP | 137699 | A2 | 4/1985 | |
| EP | 265257 | A2 | 4/1988 | |
| EP | 508934 | A1 | 10/1992 | |
| WO | WO 2011/006973 | * | 1/2011 | C11D 3/22 |

* cited by examiner

*Primary Examiner* — Brian P Mruk

(74) *Attorney, Agent, or Firm* — Raef M. Shaltout

(57) ABSTRACT

A synergistic mixture for promoting soil release from fabric, under laundry washing conditions, which comprises a polyacrylate polymer and at least one water soluble modified cellulose ether. The polyacrylate polymer comprises: (i) 90-100 weight % of polymerized units derived from acrylic acid and (ii) up to 10 weight % of polymerized units derived from one or more $C_3$-$C_8$ monoethylenically unsaturated carboxylic acids, based on the total weight of said polyacrylate polymer. A laundry formulation is also provided which contains the synergistic mixture in an amount of up to 2 weight %, based on the total weight of the laundry formulation. Also provided are methods of promoting soil release from soiled fabric which involve contacting the soiled fabric with an aqueous solution comprising the above-described inventive synergistic mixture or with the above-described laundry formulation.

9 Claims, No Drawings

METHOD OF PROMOTING SOIL RELEASE FROM FABRICS

CROSS REFERENCE TO RELATED APPLICATIONS

This application is a 35 USC §371 national phase filing of PCT/US2012/037298 filed May 10, 2012, which claims the benefit of EP Application No. 11290236.6, filed May 20, 2011.

FIELD OF THE INVENTION

The present invention relates to a method of promoting soil release from fabrics using a synergistic mixture of a polyacrylate polymer and a modified cellulose ether in domestic laundry conditions.

BACKGROUND OF THE INVENTION

When a fabric garment is worn, soil and/or oily materials tend to accumulate and settle on and among the fibers of the fabric. Soiled garments are often cleaned under domestic laundry conditions, i.e., using laundry detergent formulations in aqueous solutions. Previously, oily soil would have been removed using very hot (typically 60° C.-90° C.) wash conditions, however, the current trend is to save energy by washing laundry at much lower temperatures, i.e., in the region of 15° C.-50° C. Unfortunately, however, oily soil is not easily removed at this temperature.

The development of laundry formulations which are capable of cleaning soiled fabric garments at lower temperatures (e.g., 15° C.-50° C.) is an ongoing endeavor and has led to laundry formulations containing a variety of additives including, but not limited to, dispersants, film formers, emulsifiers, surfactants, and builders. Certain polycarboxylate polymers, such as partially hydrolyzed acrylamide polymers and certain copolymers of methacrylic acid with ethyl acrylate, are very effective soil-release agents at low levels on the fabric.

For example, a polycarboxylate polymer in an aqueous acidic solution having a pH of less than 3 is described in U.S. Pat. No. 3,912,681 as capable of imparting non-permanent soil-release characteristics to cotton and cotton-blend fabrics. It is necessary to include a mineral acid in the aqueous solution to bring the pH below 3 and facilitate application of the polycarboxylate polymer. Thus, the technology disclosed in U.S. Pat. No. 3,912,681 is not suitable for consumer use, nor is it compatible with laundry detergent formulations which typically have a pH greater than 8.5.

U.S. Pat. No. 6,451,756 describes hydrophobically modified polycarboxylate polymers that are useful for promoting soil release on cotton and cotton blend fabrics under typical household laundry washing conditions, i.e., in aqueous solutions at temperatures between 15° C. and 50° C.

Another class of soil-release agents is alkyl or hydroxyalkyl cellulose derivatives. For example, as described in U.S. Pat. No. 4,136,038, methylcellulose compounds have been known for decades as successful soil release agents in laundry detergents.

The U.S. Pat. No. 4,000,093 discloses laundry detergents which comprise from 0.1% to 3%, by weight, of alkyl-, hydroxyalkyl-cellulose or alkylhydroxyalkyl-cellulose, and also from 5% to 50%, by weight, of surfactant which consists substantially of $C_{10}$-$C_{13}$-alkyl sulfate and has up to 5% by weight of $C_{14}$-alkyl sulfate and fewer than 5% by weight of alkyl sulfate having alkyl radicals of $C_{15}$ and higher.

U.S. Pat. No. 7,316,995 describes laundry detergents or cleaning formulations containing a water soluble builder system combined with cellulose derivatives which improve the soil release properties of fabrics. Cellulose derivatives suitable for use in the technology described in U.S. Pat. No. 7,316,995 include alkyl and hydroxyalkyl cellulose derivatives.

Mixtures of soil release agents with other additives for soil removal have also been proposed. For example, U.S. Patent Application Publication No. US 2009/0110870 A1 describes a soil resist additive comprising a mixture of at least one soil resist agent which is one or more fluorinated polyurethane, fluorinated acrylate or fluorinated methacrylate, and at least one additive which is maleic anhydride.

However, despite the extensive research activity in this field, there remains a need for a soil release additive which has superior soil release properties, especially oil- and grease borne soil, and which is highly effective on natural fabrics such as cotton, and cotton-blend fabrics, as well as synthetic fabrics such as polyester, and polyester-cotton fabrics, at low temperatures under domestic laundry conditions.

SUMMARY OF THE INVENTION

The present invention provides a mixture for promoting soil release from fabric, under laundry washing conditions, which comprises a polyacrylate polymer and at least one water soluble modified cellulose ether, in a molar ratio of polyacrylate polymer:water soluble modified cellulose ether which is between 1:10 and 10:1. The polyacrylate polymer comprises: (i) 90-100 weight % of polymerized units derived from acrylic acid and (ii) up to 10 weight % of polymerized units derived from one or more $C_3$-$C_8$ monoethylenically unsaturated carboxylic acids, based on the total weight of said polyacrylate polymer. The water soluble modified cellulose ether is at least one compound selected from the group consisting of: alkyl cellulose derivatives, hydroxyalkyl cellulose derivatives and carboxylalkyl cellulose derivatives. For example, the water soluble modified cellulose may comprise methyl cellulose.

In one embodiment, the polyacrylate polymers have a weight average molecular weight of between 500 and 5,000 Daltons.

The present invention also provides a method of promoting soil release from soiled fabric comprising contacting the soiled fabric with an aqueous solution comprising the above-described inventive synergistic mixture.

The present invention also provides a laundry detergent formulation comprising the above-described inventive synergistic mixture of polyacrylate polymer and at least one water soluble modified cellulose ether. More particularly, the laundry detergent formulation comprises up to 2 weight % of the synergistic mixture, based on the total weight of the laundry formulation.

Finally, a method of promoting soil release from soiled fabric is provided which comprises contacting the soiled fabric with the above-described a laundry detergent formulation.

DETAILED DESCRIPTION OF THE INVENTION

Initially, it is noted that in the following description, endpoints of ranges are considered to be definite and are recognized to incorporate within their tolerance other values within the knowledge of persons of ordinary skill in the art, including, but not limited to, those which are insignificantly different from the respective endpoint as related to this invention (in other words, endpoints are to be construed to incorporate values "about" or "close" or "near" to each respective endpoint). The range and ratio limits, recited herein, are combinable. For example, if ranges of 1-20 and 5-15 are recited for a particular parameter, it is understood that ranges of 1-5, 1-15, 5-20, or 15-20 are also contemplated and encompassed thereby.

Unless otherwise stated, all percentage amounts stated hereinafter are weight percents.

"Polymer" means a polymeric compound or "resin" prepared by polymerizing monomers, whether of the same or different types. Homopolymers are generally understood to be polymeric compounds which have been prepared from a single type of monomer. Similarly, copolymers are polymeric compounds prepared from at least two different types of monomers.

The term "polymerized units derived from" as used herein refers to polymer molecules that are synthesized according to polymerization techniques wherein a product polymer contains "polymerized units derived from" the constituent monomers which are the starting materials for the polymerization reactions. The proportions of constituent monomers, based on the total of all constituent monomers, that are used as starting materials for a polymerization reaction are assumed to result in a polymer product having the same proportions of units derived from those respective constituent monomers. For example, where 80%, by weight, of acrylic acid monomer and 20%, by weight, of methacrylic acid monomer are provided to a polymerization reaction, the resulting polymer product will comprise 80% by weight of units derived from acrylic acid and 20% by weight of units derived from methacrylic acid. By definition, a homopolymer comprises 100% by weight of units derived from a single species of monomer, such as only acrylic acid, or only maleic acid, etc.

The term "soil-release" in accordance with the present invention refers to the ability of the fabric to be washed or otherwise treated to remove soil and/or oily materials that have come into contact with the fabric.

The present invention relates, generally, to a mixture for promoting soil release from fabric, under typical laundry washing conditions. Typical laundry washing conditions means that the fabrics are contacted with the mixture in aqueous solution and temperatures between 15° C. and 90° C., such as, for example without limitation, between 15° C. and 50° C.

According to the present invention, the mixture generally comprises a polyacrylate polymer comprising 90-100% by weight of polymerized units derived from acrylic acid, based on the total weight of the polymer, and at least one water soluble modified cellulose ether comprising hydroxy propylmethylcellulose.

The polyacrylate polymer should comprise 90-100 weight % of polymerized units derived from acrylic acid, and up to 10 weight % of polymerized units derived from one or more $C_3$-$C_8$ monoethylenically unsaturated carboxylic acids, based on the total weight of said polyacrylate polymer. In a preferred embodiment, the polyacrylate polymer is a homopolymer comprising 100% of units derived from acrylic acid. The $C_3$-$C_8$ monoethylenically unsaturated carboxylic acids may be one or more compounds selected from the group consisting of: methacrylic acid, alpha-ethacrylic acid, beta-beta-dimethylacrylic acid, methylenemalonic acid, vinylacetic acid, allylacetic acid, ethylidineacetic acid, propylidineacetic acid, crotonic acid, maleic acid, maleic anhydride, fumaric acid, itaconic acid, citraconic acid, mesaconic acid, and alkali and metal salts thereof. The polyacrylate polymer may, for example without limitation, comprise at least 30 weight % acrylic acid with the remainder being one or more of methacrylic acid, maleic acid, maleic anhydride, and itaconic acid. Methods for preparing the polyacrylate polymers are well-known and understood by persons of ordinary skill in the relevant art, and are not particularly limited. Therefore, the polyacrylate polymers may be produced by any polymerization method which would produce polyacrylate polymers of the types defined hereinabove as suitable for use in the present invention.

Moreover, the polyacrylate polymer used in the present invention may be provided in solid form, such as a spray dried powder or granules, or in liquid form, such as in an aqueous or co-solvent based solution. The polyacrylate polymer may also contain crosslinkers, which are often included to build molecular weight and produce modified polymer structures and conformations. The polyacrylate polymers may also be used in their acidic or neutralized forms, according to the judgment of persons of ordinary skill in the relevant art. For example, alkali metal ions suitable for neutralizing such polymers typically include sodium or potassium, alkaline earth metal cations such as magnesium and calcium, ammonium or tetra-alkyl ammonium salts, such as tetramethylammonium, or organic amine salts, such as the salts of tri-$C_1$-$C_4$ alkylamines, hydroxyethylamines, or the mono-, di- or tri-$C_1$-$C_4$-alkanolamines, or mixtures thereof.

The molecular weight of the polyacrylate polymer, as used herein means the weight average molecular weight ($MW_w$) of the polymer backbone as measured in the polymer product after exhaustive hydrolysis. Polyacrylate polymers suitable for use in accordance with the present invention include, without limitation, those having a $MW_w$ of between 500 and 500,000 Daltons, preferably, for example, from 500 to 150,000, or more preferably from 1,000 to 20,000, or even more preferably from 500 to 5,000, or most preferably from 1,000 to 2,000 Daltons.

Gel Permeation Chromatography (GPC) is a well known and widely practiced analysis technique and was performed using a GPC liquid chromatograph to determine the weight average molecular weights of the polyacrylate polymers used in the present invention. Samples were diluted to approximately 0.2% polymer solids in the GPC mobile phase. The GPC chromatograph used refractive index detection, an aqueous phosphate buffer solution and a column set appropriate to the molecular weight being analyzed. The reagents used included: water, high performance liquid chromatography (HPLC) grade or equivalent; sodium dihydrogen phosphate, $NaH_2PO_4$, 2 H2O reagent grade (99% min.); sodium hydroxide solution 0.5M reagent grade; and molecular weight standards for samples being analyzed. Furthermore, the GPC conditions employed during analysis included: mobile phase set to 0.02 Molar $NaH_2PO_4$, 2 $H_2O$ pH 7.0; flow rate set to 1 milliliter per minute; injection size of 100 μl; and a run time of 25 minutes.

The water soluble modified cellulose ether may be one or more compounds selected from the group consisting of: alkyl cellulose derivatives, hydroxyalkyl cellulose derivatives and carboxylalkyl cellulose derivatives. Ethylcellulose compounds are not water soluble and, therefore are, by definition, excluded from the category of cellulose ethers suitable for use in connection with the present invention. It is noted that hydroxyethylcellulose and its derivatives are water soluble and, therefore, are reasonably expected to be suitable for use according to the various embodiments of the present invention. For example, without limitation, any of the following types of compounds are suitable for use in the present invention: methyl cellulose, hydroxypropyl methyl cellulose, carboxymethylcellulose, hydroxyethylcellulose, and mixtures thereof. In a preferred embodiment, the water soluble modified cellulose is an hydroxypropyl methyl cellulose.

Methods for preparing the water soluble cellulose ether derivatives are well-known and understood by persons of ordinary skill in the relevant art, and are not particularly limited. Therefore, the water soluble cellulose ether derivatives may be produced by any method which would produce water soluble cellulose ether derivatives of the types defined hereinabove as suitable for use in the present invention.

The two above-stated components are present in the mixture according to the present invention in a molar ratio of (polyacrylate polymer):(water soluble modified cellulose ether) of from 1:10 to 10:1, such as for example without limitation from 1:4 to 4:1, or even simply 1:1. In a preferred embodiment, the molar ratio is 1:1.

Another embodiment of the present invention provides a laundry detergent formulation which contains the mixture of a polyacrylate polymer and a water soluble cellulose ether derivative. Such laundry detergent formulations may also include additional components as are typical for laundry detergents including, without limitation, carrier solvents, cleaners, colorants, dispersants, etc. Laundry detergent formulations in accordance with the present invention may comprise up to 2 weight % of the mixture of polyacrylate polymer and water soluble cellulose ether derivative, based on the total weight of said formulation. More particularly, such formulations may comprise up to 1 weight % of the polyacrylate polymer and up to 1 weight % of the water soluble modified cellulose ether, based on the total weight of the formulation.

The present invention also relates to a method of promoting soil release from soiled fabric. This method comprises contacting the soiled fabric with the mixture of the present invention as described hereinabove, in an aqueous solution. Another method in accordance with the present invention comprises contacting the soiled fabric with the laundry detergent formulation of the present invention, which is also described hereinabove.

It is contemplated that the mixture of polyacrylate polymer and water soluble cellulose ether derivative of the present invention will be made to contact the fabric, in accordance with the aforesaid methods of the present invention, in at least one of the following ways: i) by, for example, dabbing, dipping or spraying the fabric with a solution containing the mixture of the present invention prior to soiling, this may be carried out as a fabric pre-use treatment operation to protect the surface of the fabric to prevent it from staining during use; ii) contacting the fabric with a solution of the mixture by, for example, dabbing, spraying or dipping prior to washing in a "pre-spotting" fabric treatment operation; iii) combining the mixture with a laundry detergent formulation so that the polymer contacts the fabric using a "through-the-wash" treatment process and iv) combining the mixture with a rinse added fabric softener through the rinse cycle of a laundry washing operation.

The various embodiments of the present invention are effective at promoting soil release from fabrics made of natural and synthetic fibers. For example, the soiled fabrics to which the present invention is applicable include those with are made, at least in part, of cotton or a cotton blend, as well as polyester or a polyester blend, or even combinations thereof.

EXAMPLES

The use, application and benefits of the present invention will be clarified by the following discussion and description of exemplary embodiments and applications of the mixture and laundry formulations present invention.

Material and Equipments:

Scanner: Epson Perfection 4490 Photo.

Epson scan software: Professional mode.

Software for image analysis: Image J v 1.4.3.67 (free software on internet) using internal Dow proprietary macro.

European washing machines: Miele Novotronic W1614 waterproof system:

Program 40° C.-"water+"

Cotton program 1200 rpm

Water hardness: 30° French Hardness, Ca/Mg 4/1 ratio.

Woven cotton fabrics from Center For Testmaterials BV Vlaardingen Netherlands, reference CN-2 05-2010

Knitted cotton fabrics from Center For Testmaterials BV Vlaardingen Netherlands, reference CN-42-008

Ballast fabrics: 3.3 kg per washing machine, from local supermarket.

Dow Liquid laundry detergent composition is provided in Table 1 below.

TABLE 1

| Dow liquid laundry composition (in order of addition) | % ACTIVE (in Finished Product) |
|---|---|
| Deionized Water | 50 |
| Linear Alkyl Benzene Sulfonate (Nansa SS80 from Huntsman) | 19 |
| Alcohol Ethoxylate (Neodol 25-7 from Shell) | 11 |
| Trisodium Citrate•$2H_2O$ (from Merck) | 2 |
| Propylene Glycol(from VWR International) | 5 |
| Fatty acid soap (Prifac 7908 from Croda) | 8.5 |
| Ethanol absolute (from Merck) | 2 |
| hydrotrope (Eltesol SX30 from Huntsman) | 2.5 |
| 30% NaOH (from VWR International) to pH = 8.5 | |
| Deionized Water | to 100% |

16 different kinds of stains were applied to the cotton woven fabrics and knitted cotton fabrics from Center For Testmaterials BV Vlaardingen Netherlands. The 16 kinds of stains are listed in Table 2 below.

TABLE 2

| ode stains for woven cotton (CN-2 05-2010) | Code stains for knitted cotton (CN-42-008) | Nature stains |
|---|---|---|
| C-H010 | KC-H010 | Cocoa, cooked up with milk |
| C-H012 | KC-H012 | Curry |
| C-H013 | KC-H013 | Duty motor oil |
| C-H018 | KC-H018 | Ground soil (garden soil) |
| C-H021 | KC-H021 | Lipstick #2 |
| C-H022 | KC-H022 | Make up |
| C-H038 | KC-H038 | Shoepolish, brown |
| C-H039 | KC-H039 | Grass, squeezed (no extract, real grass) |
| C-H054 | KC-H054 | Dressing, Balsamico |
| C-H064 | KC-H064 | Sauce curry/oil |
| C-H071 | KC-H071 | Shoe polish black |
| C-H073 | KC-H073 | make-up diluted |
| C-H078 | KC-H078 | Lipstick #1 |
| C-H080 | KC-H080 | Grass/Mud |
| C-H082 | KC-H082 | Sebum Bey with carbon black |
| C-H084 | KC-H084 | Nivea visage face cream |

Protocol:

Preconditioning Phase

Two types of cotton fabric, knitted (CN-42-008), and woven (CN-2 05-2010) from Center For Testmaterials BV, Vlaardingen Netherlands, were preconditioned with the Dow Liquid laundry detergent (see Table 1 above) containing either:

A: no soil release technology;

B: 2% ai (ai=active content) of the modified cellulose (for instance: Methocel E3 PRLV from Dow);

C: 2% ai of the polyacid (for instance, Acusol 402 from Dow); or

D: 2% ai of a blend consisting of 1% ai of the modified cellulose (for instance: Methocel E3 PRLV from Dow) and 1% ai of the polyacid. (For instance, Acusol 402 from Dow).

The preconditioning protocol was as follows: 3 cycles, using 67.5 g liquid laundry, program 40° C. "water+"; 1200 rpm. In each machine, there were 6 woven cotton fabrics, 6 knitted cotton and no ballast fabrics.

Six replicates were performed for each formulation (A, B, C and D).

Stain Phase

Then, the fabrics were stained with 16 different stains (see Table 2 above, for detail) by Center For Testmaterials BV, Vlaardingen Netherlands.

Prior to the wash phase, each stain was scanned, using the Epson Perfection 4490 Photo scanner (for more detail, see paragraph below entitled "Measurement").

Wash Phase

Then the pretreated and stained fabrics were washed with the Dow liquid laundry composition (see Table 1) containing either:

A: no soil release technology;

B: 2% ai (ai=active content=weight percent) of the modified cellulose (for instance: Methocel E3 PRLV from Dow);

C: 2% ai of the polyacid (for instance, Acusol 402 from Dow); or

D: 2% ai of a blend consisting of 1% ai of the modified cellulose (for instance: Methocel E3 PRLV from Dow) and 1% ai of the polyacid. (For instance, Acusol 402 from Dow).

The protocol was as follows: 1 cycle for the wash, using 72.8 g Dow liquid laundry, program 40° C. "water+"; 1200 rpm. In each machine, there were 1 woven cotton fabrics, 1 knitted cotton and 3.3 kg ballast fabrics.

Six replicates were performed for each formulation (A, B, C and D).

Prior to taking the measurements of performance, the fabrics were air dried (no use of dryer) overnight in a dark place, to prevent any discoloration of stain due to light.

Measurements

The soil release effect has been measured via Delta E (ΔE) of each stain.

Delta E is defined as the color difference between the unwashed stain and the washed stain, within the L*a*b* color space.

Each stain was measured, before and after washing, with the Epson Perfection 4490 Photo scanner, using the Epson scan software with the following settings:

Professional mode.

Document type: reflective

Documents source: Document table

Auto exposure type: photo

Image type: 48-bit color scanner quality: best

Resolution: 400 dpi

No color correction

Then, the color of each stain have been analyzed with the software Image J version 1.4.3.67 (free software available from the Internet) using a macro which provided color information within the L*a*b* color space.

Delta E of each stain was been calculated from the L*a*b* values of unwashed and washed stain, based on the following equation:

$$\Delta E=\sqrt{\{(L^*_{unwashed}-L^*_{washed})^2+(a^*_{unwashed}-a^*_{washed})^2+(b^*_{unwashed}-b^*_{washed})^2)\}}$$

When Delta E is high, the soil release is also important.

It is known that a visible color difference corresponds to Delta E of one, minimum.

Results

The Delta E results showed unexpected synergy between the polyacrylate polymer and the water soluble cellulose ether derivative for releasing some types of stains. The following Tables 3a, 3b, 4a and 4b provide the Delta E data obtained from the above-described experiments.

TABLE 3a

| Woven Cotton Fabric | A Delta E (6 replicas average) | B Delta E (6 replicas average) | C Delta E (6 replicas average) | D Delta E (6 replicas average) |
|---|---|---|---|---|
| Lipstick #1 | 53.2 | 55.1 | 55.3 | 57.7 |
| Lipstick#2 | 30.7 | 32.7 | 30.0 | 35.4 |
| Make up | 29.4 | 31.7 | 31.3 | 32.7 |
| Shoe polish black | 42.5 | 42.4 | 41.8 | 43.6 |
| make-up diluted | 28.8 | 27.8 | 33.3 | 32.8 |
| Cocoa, cooked up with milk | 16.9 | 12.1 | 15.9 | 18.3 |
| Grass, squeezed (no extract, real grass) | 18.0 | 17.6 | 19.6 | 19.0 |

TABLE 3b

| Knitted Cotton Fabric | A Delta E (6 replicas average) | B Delta E (6 replicas average) | C Delta E (6 replicas average) | D Delta E (6 replicas average) |
|---|---|---|---|---|
| Shoe polish black | 29.8 | 32.4 | 32.6 | 33.2 |
| Shoepolish, brown | 36.1 | 35.9 | 40.1 | 38.3 |
| Grass, squeezed (no extract, real grass) | 20.9 | 21.5 | 20.9 | 22.1 |
| Dirty motor oil | 33.6 | 32.4 | 36.3 | 34.8 |
| Curry | 41.5 | 40.4 | 41.6 | 44.6 |
| Grass/Mud | 38.5 | 40.1 | 40.0 | 40.7 |

Furthermore, some statistical analysis run on some stains show that the Delta E of A and Delta E of D are significantly different. The results are shown on table 4a and b.

TABLE 4a

| Woven Cotton Fabric | A Delta E (6 replicas average) | B Delta E (6 replicas average) | C Delta E (6 replicas average) | D Delta E (6 replicas average) |
|---|---|---|---|---|
| Shoepolish, brown | 28.9 | 31.7 | 38.5 | 42.0 |
| Sebum bey with carbon black | 33.4 | 36.1 | 36.9 | 37.8 |

TABLE 4b

| Knitted Cotton Fabric | | | | |
|---|---|---|---|---|
| | A Delta E (6 replicas average) | B Delta E (6 replicas average) | C Delta E (6 replicas average) | D Delta E (6 replicas average) |
| Lipstick #2 | 44.7 | 48.9 | 51.6 | 56.3 |
| Make up | 26.9 | 29.8 | 32.8 | 38.0 |
| Ground soil (garden soil) | 35.1 | 34.9 | 37.2 | 37.8 |

What is claimed is:

1. A mixture for promoting soil release from fabric, under laundry washing conditions, said mixture comprising:

(A) a polyacrylate polymer that is a homopolymer comprising 100% by weight of polymerized units derived from acrylic acid, wherein said polyacrylate polymer has a weight basis molecular weight of between 1000 and 2000 Daltons; and (B) at least one water soluble modified cellulose ether comprising hydroxypropylmethyl cellulose.

2. The mixture according to claim 1, wherein components (A) and (B) are present in a molar ratio of (polyacrylate polymer):(water soluble modified cellulose ether) of from 1:10 to 10:1.

3. A method of promoting soil release from soiled fabric comprising contacting the soiled fabric with an aqueous solution comprising the mixture according to claim 1.

4. A laundry detergent formulation comprising the mixture according to claim 1.

5. The laundry detergent formulation according to claim 4, wherein said formulation comprises up to 2 weight % of said mixture, based on the total weight of said formulation.

6. The laundry detergent formulation according to claim 4, wherein said formulation comprises up to 1 weight % of said polyacrylate polymer and up to 1 weight % of said water soluble modified cellulose ether, based on the total weight of said formulation.

7. A method of promoting soil release from soiled fabric comprising contacting the soiled fabric with a laundry detergent formulation according to claim 4.

8. The method according to claim 7, wherein the soiled fabric comprises fabric made at least in part from: cotton, a cotton blend, polyester, a polyester blend, or combinations thereof.

9. The mixture of claim 1 wherein components (A) and (B) are present in a molar ratio of 1:1.

* * * * *